United States Patent [19]

Gamberini et al.

[11] Patent Number: 5,018,539

[45] Date of Patent: May 28, 1991

[54] CIGARETTE EJECTION DEVICE

[75] Inventors: Antonio Gamberini, Bologna; Marco Ghini, San Lazzaro Di Savena, both of Italy

[73] Assignee: G.D. Societá per Azioni, Bologna, Italy

[21] Appl. No.: 431,556

[22] Filed: Nov. 2, 1989

[30] Foreign Application Priority Data

Nov. 14, 1988 [IT] Italy ..... 3661 A/88

[51] Int. Cl.[5] ..... A24C 5/345

[52] U.S. Cl. ..... 131/280; 131/907; 209/535; 209/643

[58] Field of Search ..... 131/280, 283, 284, 907; 209/535-537, 643

[56] References Cited

U.S. PATENT DOCUMENTS 4,592,470 6/1986 Mattei et al. ..... 209/535

4,760,853 8/1988 Gamberini ..... 131/283

*Primary Examiner*—V. Millin

*Assistant Examiner*—Jennifer L. Doyle

*Attorney, Agent, or Firm*—Ladas & Parry

[57] ABSTRACT

A device for feeding cigarettes to a packeting machine. Cigarettes are placed in the lower part of a hopper in stacks mobile stepwise along respective outgoing channels from the hopper. A device is provided for checking the cigarettes descending stepwise along the channels, and another device which ejects faulty cigarettes is controlled by the checking device and includes, for each channel, a pneumatic extractor connectable to a suction source and a withdrawal element able to gain access to the respective channel to extract the faulty cigarettes from the interior of the hopper.

6 Claims, 2 Drawing Sheets

CIGARETTE EJECTION DEVICE

BACKGROUND OF THE INVENTION

This invention relates to a device for feeding cigarettes to the wrapping line of a packeting machine.

The known practice is for the cigarettes to enter a packeting machine usually via a hopper which is supplied with the cigarettes in appropriate containers or from a belt conveyor, which conveys them in the form of a continuous layer.

When leaving the hopper the cigarettes are grouped into batches, each of which is made up of a number of cigarettes equal to the number in one finished packet.

A check is then made on the characteristics of the cigarettes of each batch, and those batches which contain even a single faulty cigarette are rejected.

In order to reduce the number of batches of cigarettes ejected and thereby obtain a considerable financial saving, a device has been proposed by the present applicant, Messrs. G. D. S.p.A., in U.S. Pat. No. 4,592,470 which is able to verify the soundness of the cigarettes while these are still in the hopper, and to reject them before they reach the batching station.

In this device the cigarettes are ejected from the hooper by a combination of pneumatic means and mechanical means.

More specifically, when commanded by the means which check the cigarette soundness, a nozzle directs an air blast agains the end of each faulty cigarette.

Under the force of this blast the cigarette begins to emerge from the hopper through an appropriate aperture, so that its opposite end is pierced by a sharp element or needle. This latter, driven with reciprocating movement, withdraws from the hopper to thus complete the removal of the faulty cigarettes.

A device of this type is not however free of problems, which derive both from the pneumatic means and from the mechanical means.

The air blast directed agains the end of the cigarettes tends to expel tobacco particles, which can fall onto the underlying members and hinder correct operation of the machine.

A more serious problem arising in such a device derives from the use of said needles, or sharp elements in general, which can constitute a danger to the operator, particularly if they break.

SUMMARY OF THE INVENTION

The object of the present invention is to provide a device of the aforesaid type in which the described problems of the known art do not arise.

Said object is attained according to the present invention by a device for feeding cigarettes to the wrapping line of a packeting machine, comprising a hopper for supplying cigarettes to said machine, the lower part of said hopper being divided by dividing walls into outgoing channels having a width substantially equal to the diameter of one cigarette and through which the cigarettes placed in stacks descend stepwise; there being provided sensor means associated with each channel for checking the cigarettes in succession, and a faulty cigarette ejection device, controlled by said sensor means, for removing the faulty cigarettes from said hopper; said device being characterised in that said ejection device comprises, for each channel, a pneumatic extractor connectable to a suction source and provided with a withdrawal element arranged to engage and retain one cigarette, said withdrawal element being mobile, parallel to the cigarette axes, between a withdrawal position, defined by an access communicating with the interior of the respective channel, and a disengagement position, in which the withdrawal element is spaced from said hopper by a distance at least equal to the length of one cigarette. The novel features which are considered as characteristic of the invention are set forth in particular in the appended claims. The device itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
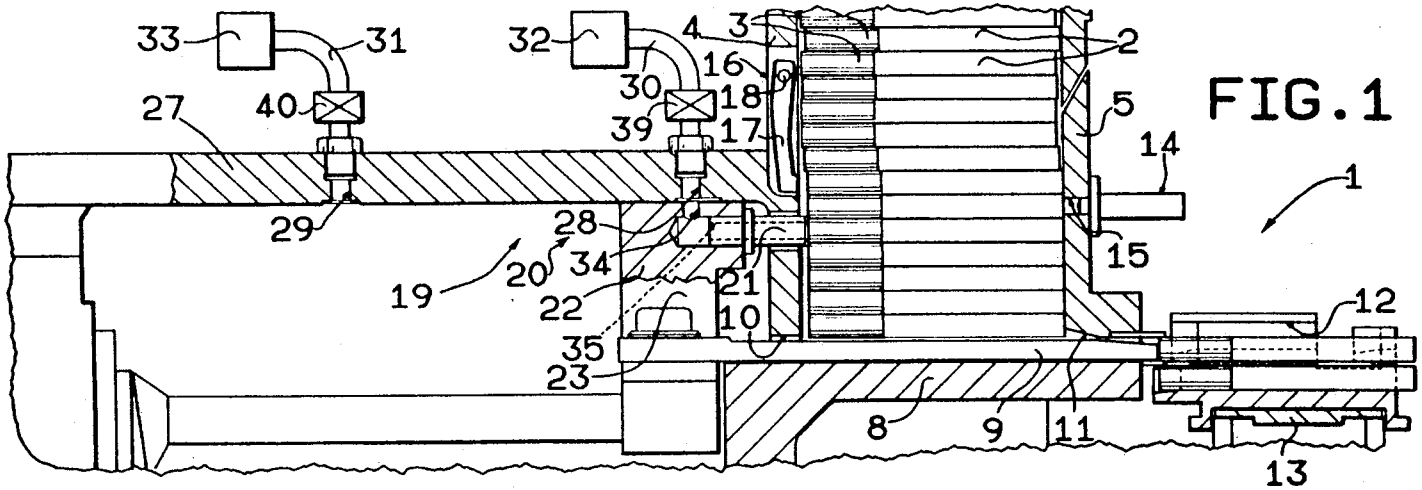
FIGS. 1 and 2 are sectional side view of the device according to the present invention in two different operating positions.
Figure 2:
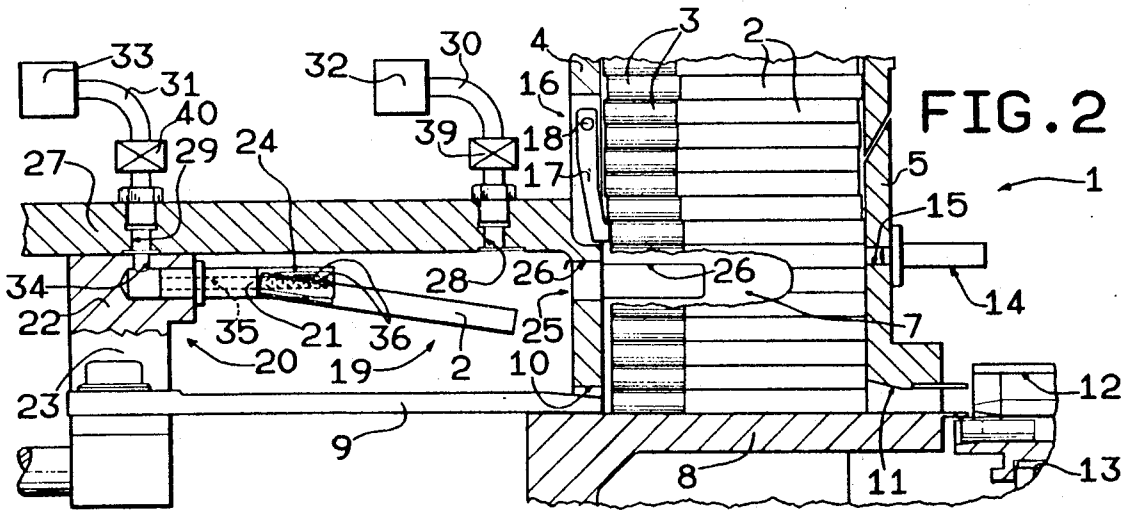

FIGS. 1 and 2 show an intake hopper 1, of known type, for feeding cigarettes 2, comprising a filter 3, to a cigarette packeting machine (not shown).

The hopper is defined by a left-hand wall 4, facing the filters 3, and a right-hand wall 5, which are vertical and parallel to each other and define a compartment having a width approximate to but slightly greater than the length of one cigarette 2.

Figure 3:
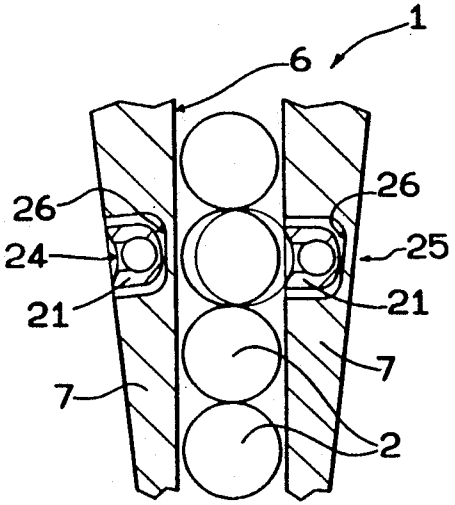
FIG. 3 is a front view of a detail of FIGS. 1 and 2.

This compartment is divided into a plurality of elementary channels 6 (of which only one is shown) by baffles or dividing walls 7 positioned at a distance apart approximate to but slightly greater than the diameter of the cigarettes 2 (see FIG. 3).

The elementary channels 6 are bounded at their bottom by a horizontal wall which supports the comumns of cigarettes 2 contained in the channels 6.

Said cigarettes 2 are engaged in batches at the end comprising the filter 3 by a pusher element 9 mobile with reciprocating motion perpendicular to the walls 4 and 5 through horizontal slits 10 and 11 provided in the walls 4 and 5 in a position adjacent to the wall 8 and of a height at least equal to the diameter of the cigarettes 2.

The pusher element 9 is movable from a non-active position outside the hopper 1 to an operative position inside the hopper 1 for pushing the cigarettes 2 from the channels 6 into containers 12 (of which only one is shown) carried by a conveyor belt 13 provided with intermittent motion, for transferring the batches of cigarettes 2 to a packeting unit, not shown.

To understand better the structure of the hopper 1, the channels 6, the pusher element 9 and the conveyor belt 13, reference should be made to the description and drawings of U.K. Patents Nos. 1,298,785 and 2,023,994 in the name of the present applicant, Messrs. G.D. S.p.A.

Along each channel 6, externally to the wall 5, there is provided a sensor means or device for checking the soundness of the individual cigarettes 2, and indicated overall by 14.

Said checking device 14 is shown schematically in the figures as a sensor (of optical, or mechanical, or pneumatic type) able to detect defects in the extremity of each individual cigarette 2 via a horizontal hole 15 provided through the wall 5.

Externally to the hopper 1, in proximity to the wall 4 facing the filters 3, there is provided a device 16 for axially adjusting the cigarettes 2.

Said adjustment device 16 consists, for each channel 6, of an arm 17 pivoted on a horizontal pin 18 perpendicular to the axes of the cigarettes 2.

Actuator means, not shown, impress on the device 16 a rocking movement of a frequency such as to cause the free end of the arm 17 to make contact, during each halt period of the stack, with the filter 3 of each cigarette 2 and exert a sufficient pressure to move those extremities to be checked into line with the wall 5.

At a lower level than the checking device 14 there is provided a device for ejecting the faulty cigarettes 2, which is indicated overall by 19.

Said device comprises, for each channel 6, a pneumatic extractor 20 provided with a withdrawal element 21 mounted on a block 22 supported by the pusher 9 via a bracket 23.

Figure 6:
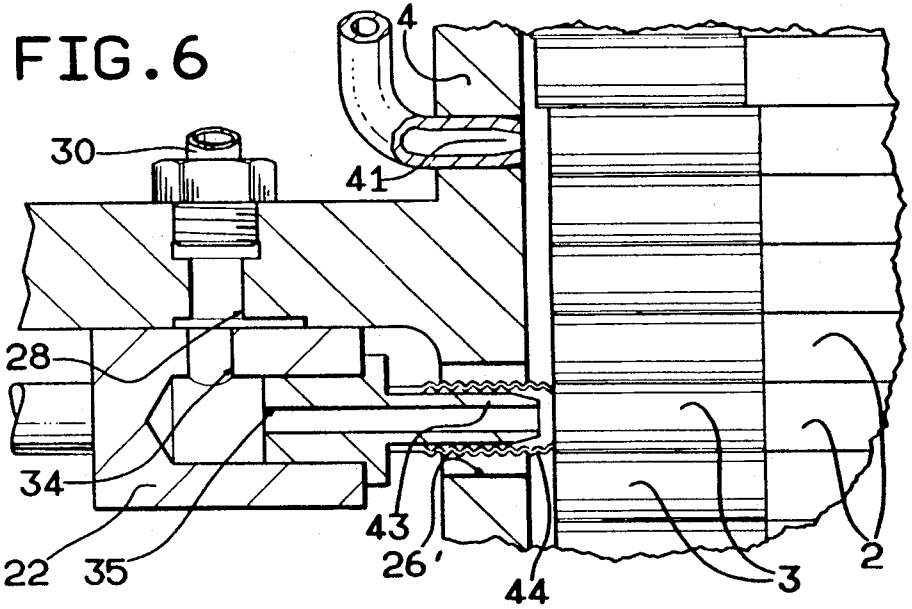
FIGS. 6 and 7 are side views of a second embodiment of the device according to the invention in two different operating positions.
Figure 4:
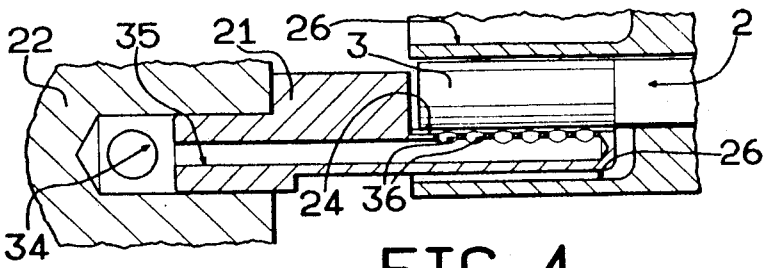
FIG. 4 is a section through a detail of the device according to the invention.

Said withdrawal element 21, the level of which is lower than that of the respective sensor 14 by a distance equal to or a multiple of the diameter of one cigarette 2, has one end in the form of an elongated curved plate with its longitudinal axis (see FIG. 2) parallel to the axes of the cigarettes 2 and its concave surface, indicated by 24, facing the interior of the respective channel 6 as best seen in FIG. 6.

By means of the described connection, each extractor 20 is mobile together with the pusher 9 with axial reciprocating motion relative to the wall 4 of the hopper 1.

More specifically, when the pusher 9 is located in its end-of-travel position below the hopper 1, each pneumatic extractor 20 occupies a position, indicated by 25 and defined as the withdrawal position, in which an access into the respective channel 6 is provided for the withdrawal element 21.

This access consists of an aperture or hole 26' formed in the wall 4 and, aligned with it, a seat or recess 26 formed in one of the two baffles 7 defining said channel 6 (see also FIG. 3).

In contrast, when the pusher 9 is in its non-active position outside the hopper 1, the withdrawal element 21 occupies a position of disengagement from the channel 6 outside the hopper 1 at a distance from this latter which is at least equal to the length of one cigarette 2.

Above the device 19 there is provided a fixed horizontal plate 27, in contact with which the blocks 22 of each extractor 20 slide in an air-tight manner along their entire path.

In the inward and outward end-of-travel positions occupied by each block 22, said plate 27 is provided with vertical holes indicated respectively by 28 and 29, the former being connected by a pipe 30 to a suction source and the latter being connected by a pipe 31 to a compressed air source, which are indicated schematically by the blocks 32 and 33 respectively.

When each extractor 20 is in one of its end-of-travel positions the holes 28 and 29 in the plate 27 are aligned with a hole 34 communicating with a duct 35 extending inside the block 22 and withdrawal element 21 and connected to the outside via apertures in the form of holes 36 provided in the concave surface 24 of the withdrawal element 21.

Figure 5:
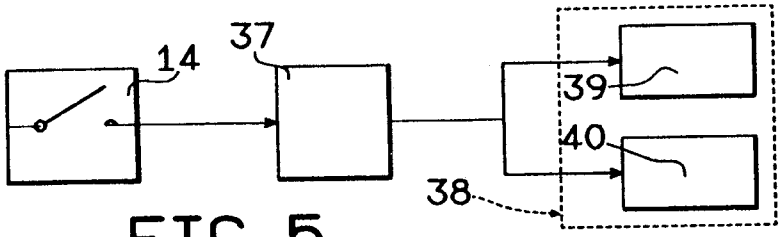
FIG. 5 represents a control circuit, in the form of a block diagram, for the device according to the invention.

With reference to the block diagram of FIG. 5, which represents a control circuit relative to each channel 6, the checking device is shown schematically as a normally open contact which closes when a cigarette 2 which is too short or not sufficiently full of tobacco at its extremity is detected.

Connected to the output of the checking device 14 there is provided a memory device 37, which controls valve means 38 comprising a first valve 39 connected into the pipe 30 and a second valve 40 connected into the pipe 31.

When in use, during the halt stage of each machine cycle and therefore when the stacks of cigarettes 2 are at rest within the channels 6, each sensor 14 via its individual hole 15 checks a respective cigarette 2, which has previously been brought into contact with the wall 5 by the axial adjustment device 16.

When a cigarette 2 is found to be faulty, the checking device 14 provides for its rejection by way of said memory device 37 and the valve means 38.

More specifically, after a determined delay which depends on the level difference, evaluated in terms of machine cycles, between the checking device 14 and the extractor device 20, the normally closed valves 39 and 40 receive an opening command with the result that the two holes 28 and 29 become connected to the suction source 32 and to the compressed air source 33 by the respective pipes 30 and 31.

As a result of this, when the faulty cigarette 2 travelling down the channel 6 reaches that halt position in which the extractor 20 operates, the withdrawal element 21, which is in its end-of-travel position within the seat 26 provided in the respective baffle 7, communicates with the suction source 32 via the connection means consisting of the hole 34 and the duct 35.

The filter 3 of said cigarette 2 therefore adheres tightly to the concave surface 24 provided with the holes 36 deriving from the block 22, which on moving away from the wall 4 withdraws the faulty cigarette 2 from the stack.

By virtue of the air-tight contact between the block 22 and plate 27, the suction force of the withdrawal element acting on the cigarette 2 does not cease after interruption of communication between the duct 35 and hole 28 as the block 22 slides towards its outer end-of-travel position.

When the block 22 reaches its outer end-of-travel position on retraction of the pusher 9, means, of which the compressed air source 33 forms part, for separating the cigarettes 2 from the extractor 20 come into operation.

In this respect, as the hole 29 in the plate 27 coincides with the hole 34, the compressed air source 33 is directly connected to the withdrawal element 21 so that air jets flowing through the holes 36 cause the faulty cigarette 2 to separate and fall into a collection vessel, not shown.

Figure 7:
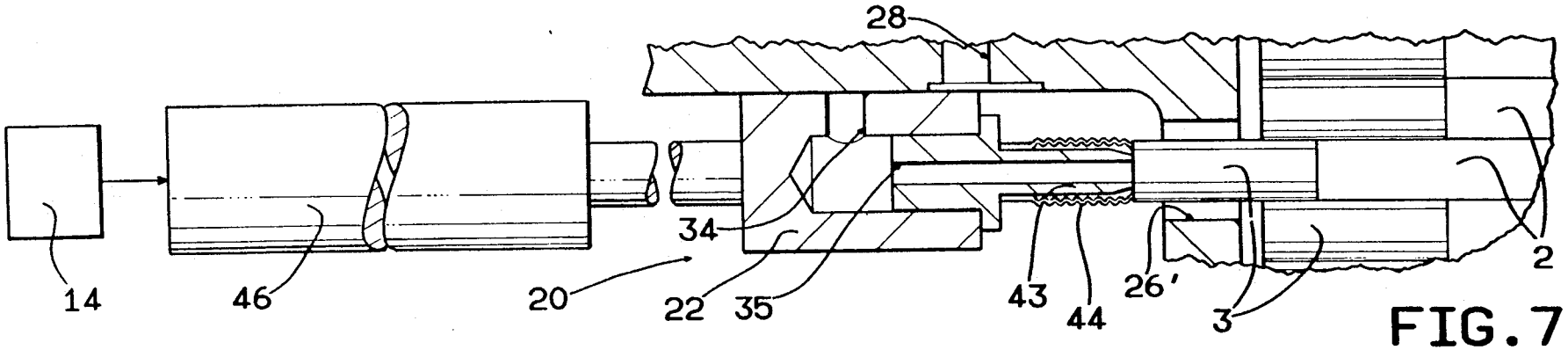

In the embodiment shown in FIGS. 6 and 7, a tubular withdrawal element 43 of diameter less than the diameter of the cigarettes 2 replaces the withdrawal element 21 of the first embodiment.

Said tubular element 43, connected in the illustrated manner to the suction source 32 by the pipe 30, is provided with a sheath of resilient material 44 which projects by a determined length beyond its free end.

For each outward stroke of the pusher 9 and consequently of the extractor 20, the tubular element 43 moves its sheath 44 through the access formed by the hole 26' provided in the wall 4, and into delicate adhesion with the extremity of a cigarette 2.

If a faulty cigarette 2 is detected by the checking device 14, the valve 39 receives an opening command via the memory device 37, and connects the suction source 32 to the tubular element 43.

As a result of this, in the space bounded by the sheath 44 and lying between the extremity of the cigarette 2 and the end of the tubular element 43 a vacuum is created which draws the cigarette 2 into contact with the mouth of the tubular element, overcoming the resistance of the sheath 44.

During the subsequent return stroke of the extractor 20 the faulty cigarette 2 is extracted from the relative channel 6 and then ejected in the aforesaid manner.

In the embodiment shown in FIGS. 6 and 7 the device 19 for ejecting the faulty cigarettes 2 is not rigid with the reciprocating pusher 9, but instead each extractor 20 is moved by a respective actuator 46.

This enables all the extractors 20 to be kept under halt conditions (for example in a position intermediate between those shown in FIGS. 6 and 7) in the absence of faulty cigarettes 2. Only when a faulty cigarette 2 is detected is the respective withdrawal element operated by the actuator 46, itself controlled by the checking device 14 associated with the respective channel 6.

It can be seen that the device according to the present invention is able to obviate all the described drawbacks of the known art. In this respect, those air blasts directed axially against the extremities of the cigarettes are no longer present, such air blasts as stated resulting in dust and the escape of tobacco particles, nor are the needles which can constitute a danger to the machine operators, particularly on breakage.

Within the principles of the inventive idea numerous modifications can be made to the said device without leaving the scope of the present invention.

The sensor means could be located on both the walls 4 and 5 of the hopper 1 to check both extremities of the cigarettes 2.

It should be noted that in the case heretofore described, in which only one extremity of the cigarettes 2 is checked, the withdrawal element 21 (43) and the checking device 14 could be positioned mutually aligned, so as to effect the checking operation and the ejection of the possibly faulty cigarette 2 during the same machine cycle.

With regard to the axial adjustment device 16, this instead of being mechanical could be of pneumatic type, for example consist of a nozzle 41 connected to a compressed air source, not shown (see FIG. 6).

In contrast, the means for separating the faulty cigarettes 2 from the extractor 20 could be of mechanical instead of pneumatic type, and consist for example of a bar (not shown) which when the extractor 20 is in its outer end-of-travel position strikes the cigarette 2 transversely to its axis.

What I claim is:

1. A device for feeding cigarettes to the wrapping line of a packeting machine, comprising:

a hopper for supplying cigarettes to said machine, the lower part of said hopper being divided by dividing walls into outgoing channels each having a width substantially equal to the diameter of one cigarette and through which the cigarettes, placed in stacks, descend stepwise;

sensor means associated with each said channel for checking cigarettes in succession; and a faulty cigarette pneumatic ejecting device, controlled by said sensor means for removing the faulty cigarettes from said hopper, comprising a withdrawal element, said pneumatic ejecting device comprising, for each said channel, a suction source connected with said withdrawal element, said withdrawal element being arranged to engage and retain one cigarette and being mobile, parallel to the cigarette axes, between a withdrawal position, defined by an access communicating with the interior of the respective said channel, and a disengagement position, in which said withdrawal element is spaced from said hopper by a distance at least equal to the length of one cigarette, said withdrawal element having an end in the form of an elongated curved plate with its longitudinal axis parallel to the axes of the cigarettes, the concave surface of said curved plate being arranged to cooperate with the lateral surface of a cigarette and being provided with apertures communicating with said suction source.

2. A device as claimed in claim 1, wherein for each channel a seat is provided in one of the dividing walls defining said channel, said seat being arranged to receive said withdrawal element.

3. A device as claimed in claim 1, wherein at least in correspondence with said withdrawal position, valve means are provided for connecting said withdrawal element to said suction source.

4. A device as claimed in claim 3, wherein in correspondence with said disengagement position, means are provided for separating the cigarettes from said withdrawal element.

5. A device as claimed in claim 1, comparing axial adjustment means for the cigarette, for adjusting the axial position of the cigarettes relative to said sensor means.

6. A device for feeding cigarettes to the wrapping line of a packeting machine, comprising:

a hopper for supplying cigarettes to said machine, the lower part of said hopper being divided by dividing walls into outgoing channels each having a width substantially equal to the diameter of one cigarette and through which the cigarettes, placed in stacks, depend stepwise;

sensor means associated with each said channel for checking cigarettes in succession; and a faulty cigarette pneumatic ejecting device, controlled by said sensor means for removing the faulty cigarettes from said hopper, comprising a withdrawal element, said pneumatic ejecting device comprising, for each said channel, a suction source connected with said withdrawal element, said withdrawal element being arranged to engage and retain one cigarette and being mobile, parallel to the cigarette axes, between a withdrawal position, defined by an access communicating with the interior of the respective said channel, and a disengagement position, in which said withdrawal element is spaced from said hopper by a distance at least equal to the length of one cigarette, said withdrawal element consisting of a tubular element with its axis parallel to the axes of the cigarettes and communicating with said suction source, said tubular element having a free end arranged to engage the extremity of one cigarette, wherein said tubular element has a diameter less than the diameter of one cigarette and is provided with a sheath of resilient material which extends beyond said end of the tubular element by a determined length.

* * * * *